US006129030A

United States Patent [19]

Resta

[11] Patent Number: 6,129,030

[45] Date of Patent: Oct. 10, 2000

[54] DEVICE FOR POSITIONING AND JOINING AT AN ANGLE THE BORDERS OF TWO CLOTHS TO BE SEWN IN A SEWING MACHINE, PARTICULARLY FOR MANUFACTURING THE CASE OF MATTRESSES

[75] Inventor: Roberto Resta, Faenza, Italy

[73] Assignee: Resta S.r.l., Faenza, Italy

[21] Appl. No.: 09/010,553

[22] Filed: Jan. 22, 1998

[30] Foreign Application Priority Data

Feb. 6, 1997 [IT] Italy ..... B097A0049

[51] Int. Cl.[7] ..... D05B 11/00

[52] U.S. Cl. ..... 112/2.1; 112/153; 112/470.07

[58] Field of Search ..... 112/2.1, 470.07, 112/306, 318, 322, 153, 475.03, 475.07, 475.08

[56] References Cited

U.S. PATENT DOCUMENTS

| | | | |
|---|---|---|---|
| 4,714,036 | 12/1987 | Raisin et al. | 112/153 X |
| 4,905,615 | 3/1990 | Pofferi | 112/2.1 |
| 4,958,579 | 9/1990 | DeWeers | 112/2.1 |
| 5,251,557 | 10/1993 | Rohr . | |
| 5,370,072 | 12/1994 | Adamski, Jr. . | |
| 5,381,743 | 1/1995 | Moll . | |
| 5,586,511 | 12/1996 | Porter et al. | 112/2.1 |

*Primary Examiner*—Peter Nerbun
*Attorney, Agent, or Firm*—Guido Modiano; Albert Josif

[57] ABSTRACT

A device for positioning and joining at an angle, by means of a sewing machine, the borders of two flaps of fabric, particularly of a horizontal cloth and of a vertical band for forming the case of a mattress, having an angular element which comprises a first laminar channel, forming a guide for the border of the cloth, and a second laminar channel, which forms a guide for the border of the band; the channels are arranged at a right angle and each channel is comprised between two walls: one wall is external to the channels and the other wall is internal thereto; respective through openings are formed in the outer wall and two feeders are also provided which comprise rotating heads which are arranged so as to tangentially engage the cloth and the band through the through openings in order to place the borders of the cloth and of the band, guided in the channels, adjacent to each other.

5 Claims, 7 Drawing Sheets

DEVICE FOR POSITIONING AND JOINING AT AN ANGLE THE BORDERS OF TWO CLOTHS TO BE SEWN IN A SEWING MACHINE, PARTICULARLY FOR MANUFACTURING THE CASE OF MATTRESSES

BACKGROUND OF THE INVENTION

The present invention relates to a device for positioning and joining at an angle the borders of two cloths to be sewn in a sewing machine, particularly for manufacturing the case of mattresses.

It is known that mattress cases are constituted by an upper cloth and a lower cloth, which are rectangular and have rounded corners and are mutually joined by a perimetric band.

The band is joined to the cloths by sewing, with the aid of a hemming machine which is in practice a sewing machine which joins together the adjacent borders of a cloth and of the perimetric band. Since the cloth is laid horizontally on the filling of the mattress and the band must surround the filling vertically, in order to achieve a seam that joins together the contiguous borders of the cloth and of the band, the sewing machine is arranged at 45°, so that the needle can pass through both borders and sew them.

The borders are currently positioned manually by operators as sewing proceeds. This requires the assigned personnel to have great skill and also perform a significant physical effort, since the cloth and the band must be properly stretched in order to avoid formation of creases.

SUMMARY OF THE INVENTION

The aim of the present invention is to provide a new device which allows to mutually position the borders of two cloths arranged at 90° to each other, particularly of a cloth and of the perimetric band of a mattress, without requiring any manual intervention.

This aim is achieved with a device for positioning and joining at an angle, by means of a sewing machine, the borders of two flaps of fabric, particularly of a horizontal cloth and of a vertical band for forming the case of a mattress, characterized by an angular element which comprises a first laminar channel, which forms a guide for the border of the cloth, and a second laminar channel, which forms a guide for the border of the band, said channels being arranged at a right angle and each channel being comprised between two walls, one wall being external to said channels, the other wall being internal thereto; respective through openings being formed in said outer wall and two feeders being further provided which comprise rotating heads which are arranged so as to tangentially engage the borders of said cloth and of said band through said through openings in order to place the borders of said cloth and of said band, guided in said channels, adjacent to each other.

BRIEF DESCRIPTION OF THE DRAWINGS

Further characteristics and advantages of the present invention will become apparent from the following detailed description of a preferred but non exclusive embodiment illustrated in the accompanying drawings, wherein.

DESCRIPTION OF THE PREFERRED EMBODIMENTS

With reference to FIGS. 1 to 6, 1 designates a generic sewing machine, which is preset to perform the hemming of a mattress. The term "hemming" designates the sewing of the peripheral border of the two upper and lower cloths of the case of a mattress to the band that peripherally surrounds the mattress.

Hemming is normally performed in two steps. In a first step, the border of a cloth laid on the filling of the mattress is joined to a border of the peripheral band. Once this operation has ended, the mattress is turned over and the border of the second cloth is sewn to the other border of the band. Accordingly, the cloth that is joined to the peripheral band is always on top of the mattress filling, while the band is perpendicular thereto and descends from the border of the cloth.

Figure 1:
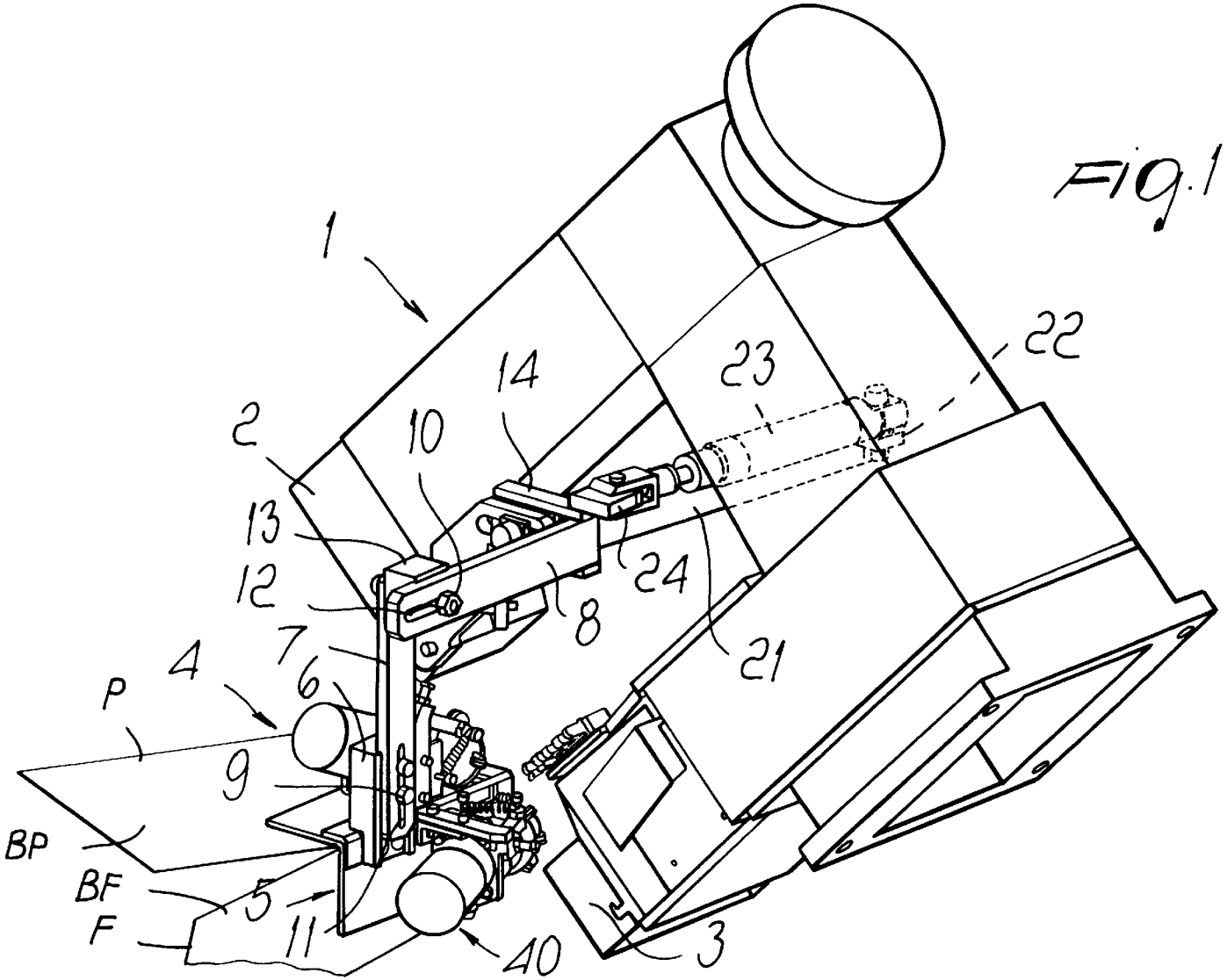
FIG. 1 is a perspective view of the device, applied to a sewing machine for manufacturing mattress cases, taken from a viewpoint located upstream of the sewing machine.
Figure 2:
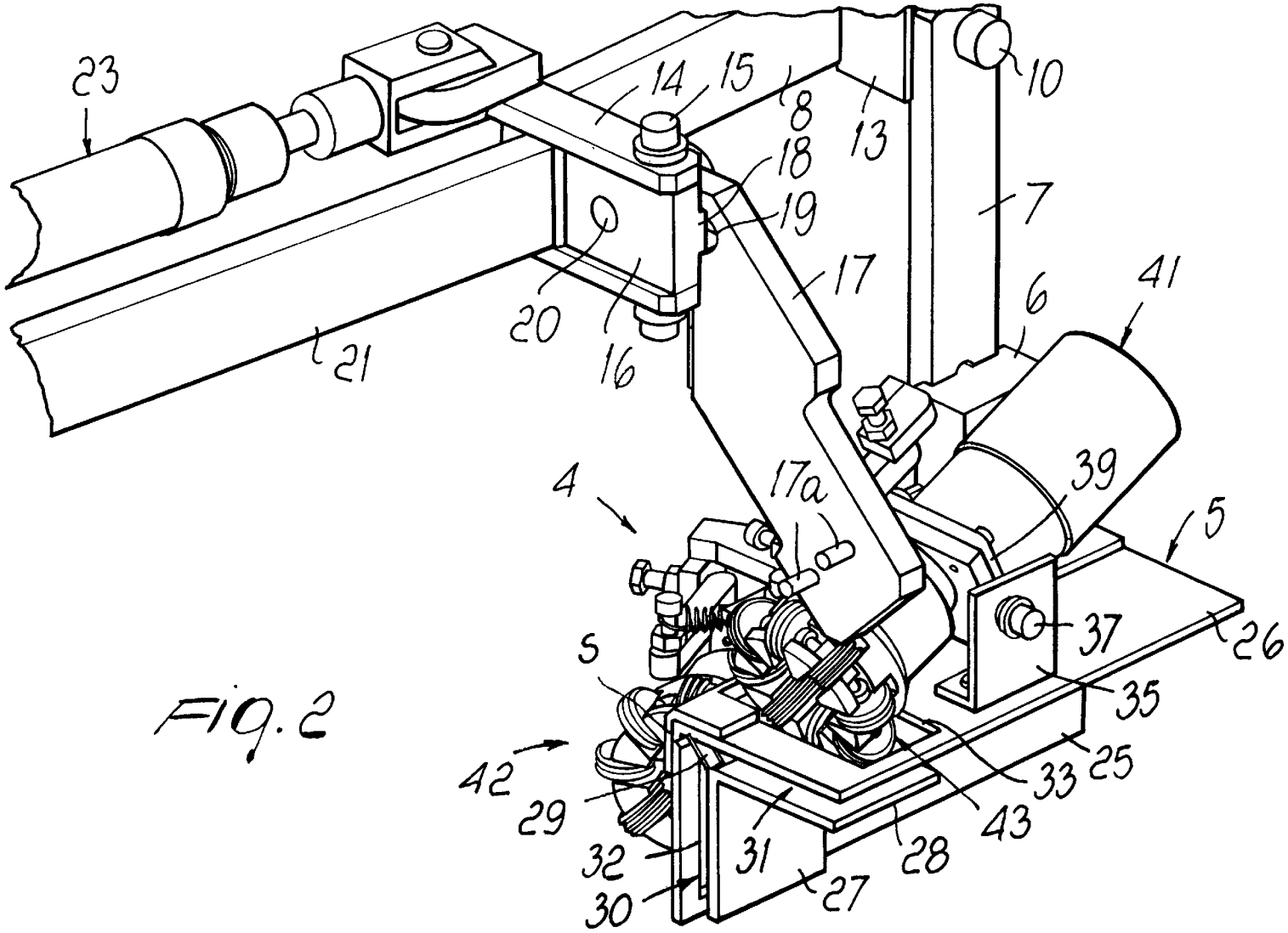
FIG. 2 is an enlarged-scale view of the device, taken from a viewpoint located upstream of the sewing machine.
Figure 3:
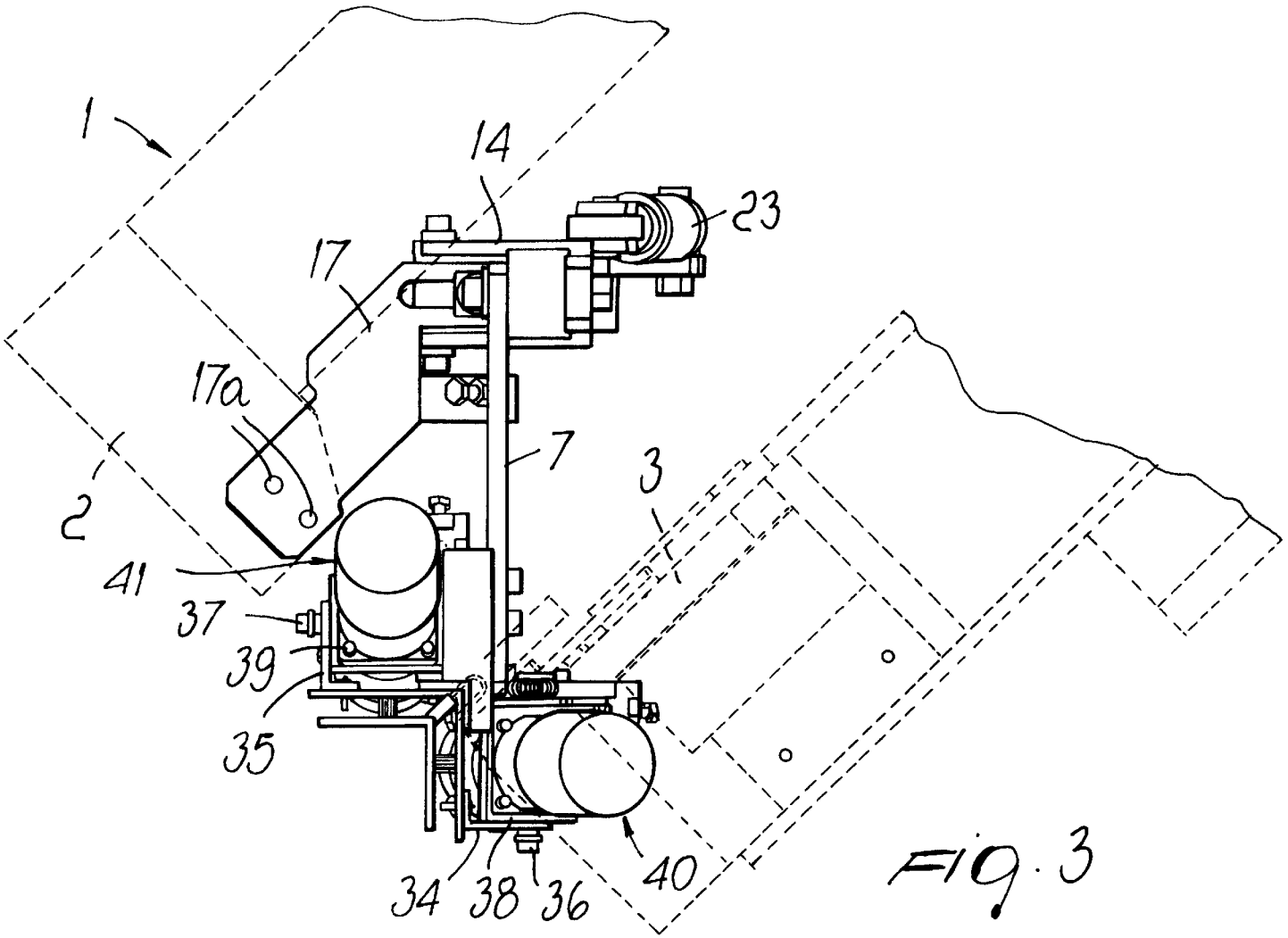
FIG. 3 is an elevation view, taken from the upstream side as in FIG. 1.
Figure 4:
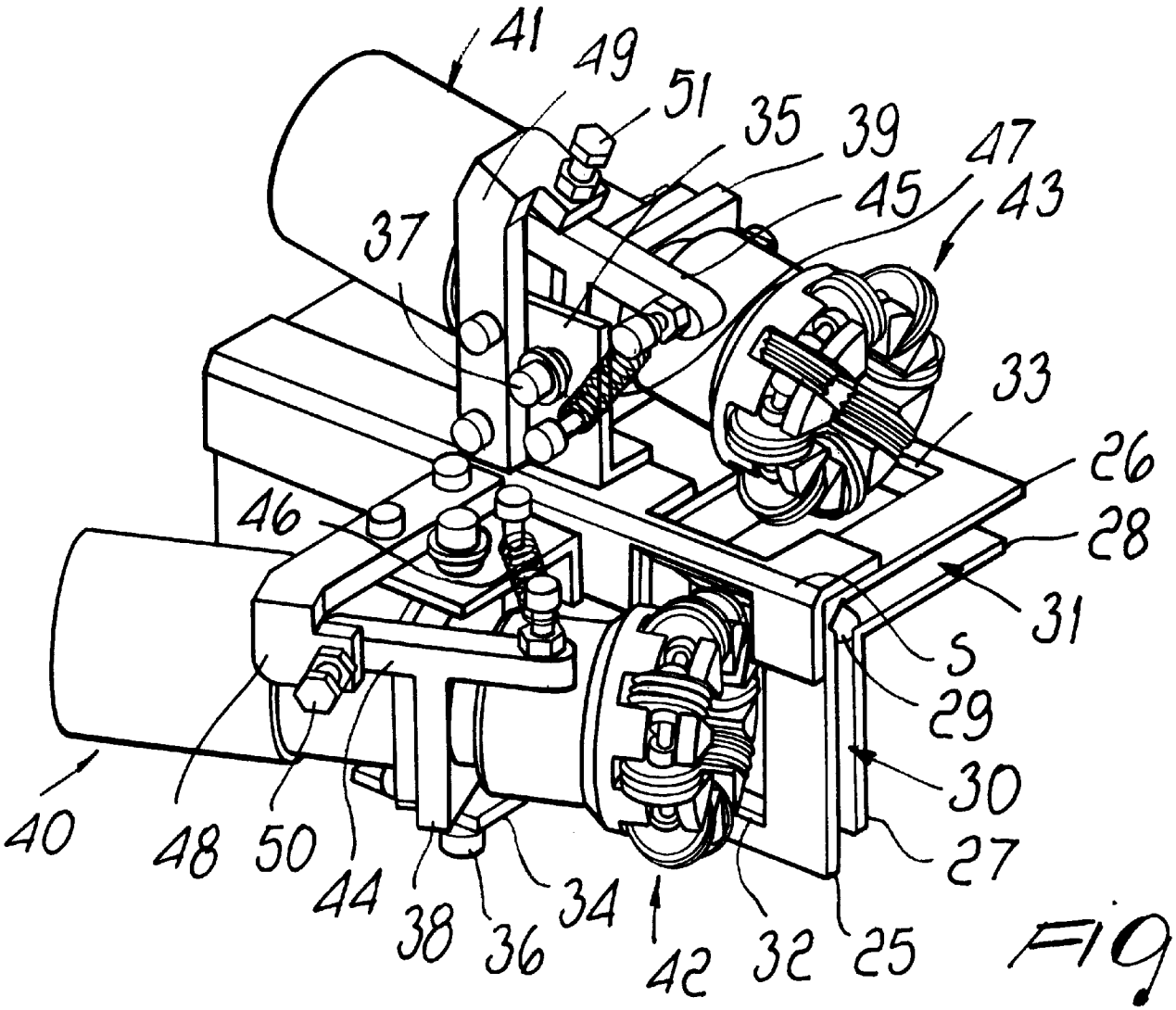
FIG. 4 is a perspective view, showing only the device.
Figure 5:
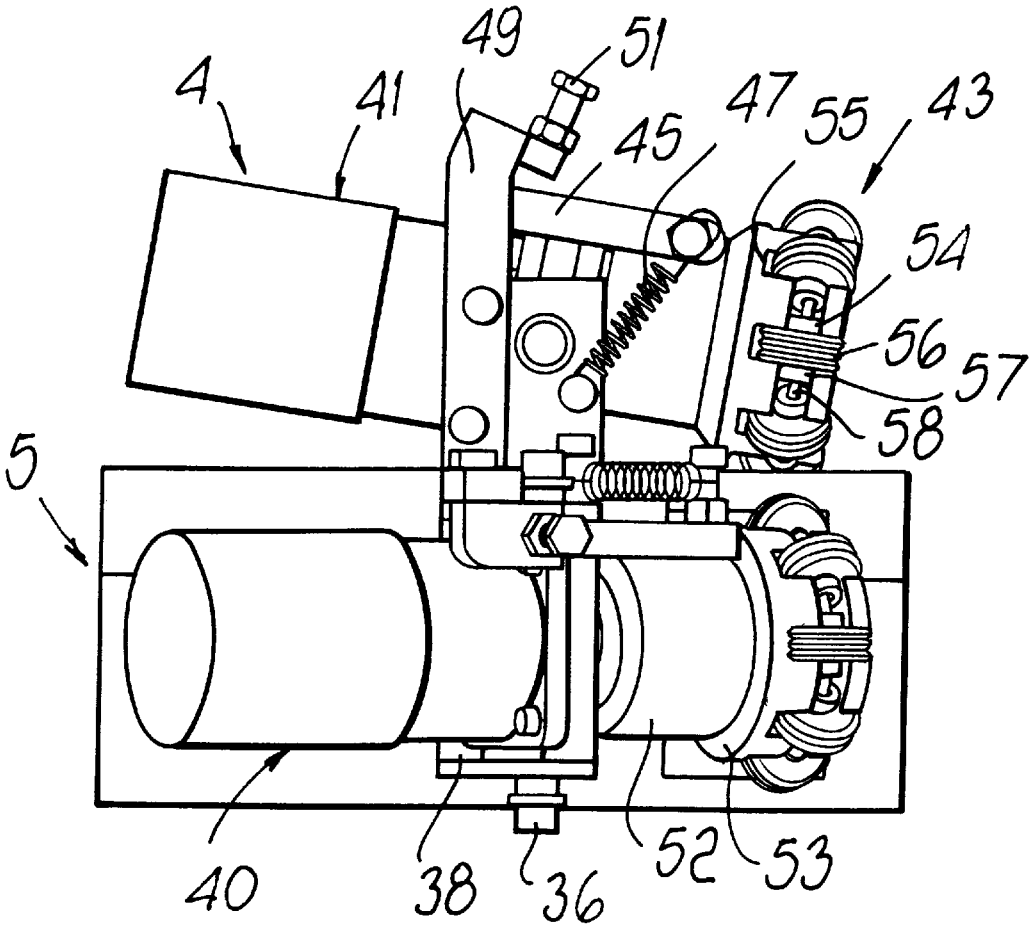
FIG. 5 is a lateral elevation view of the device.
Figure 6:
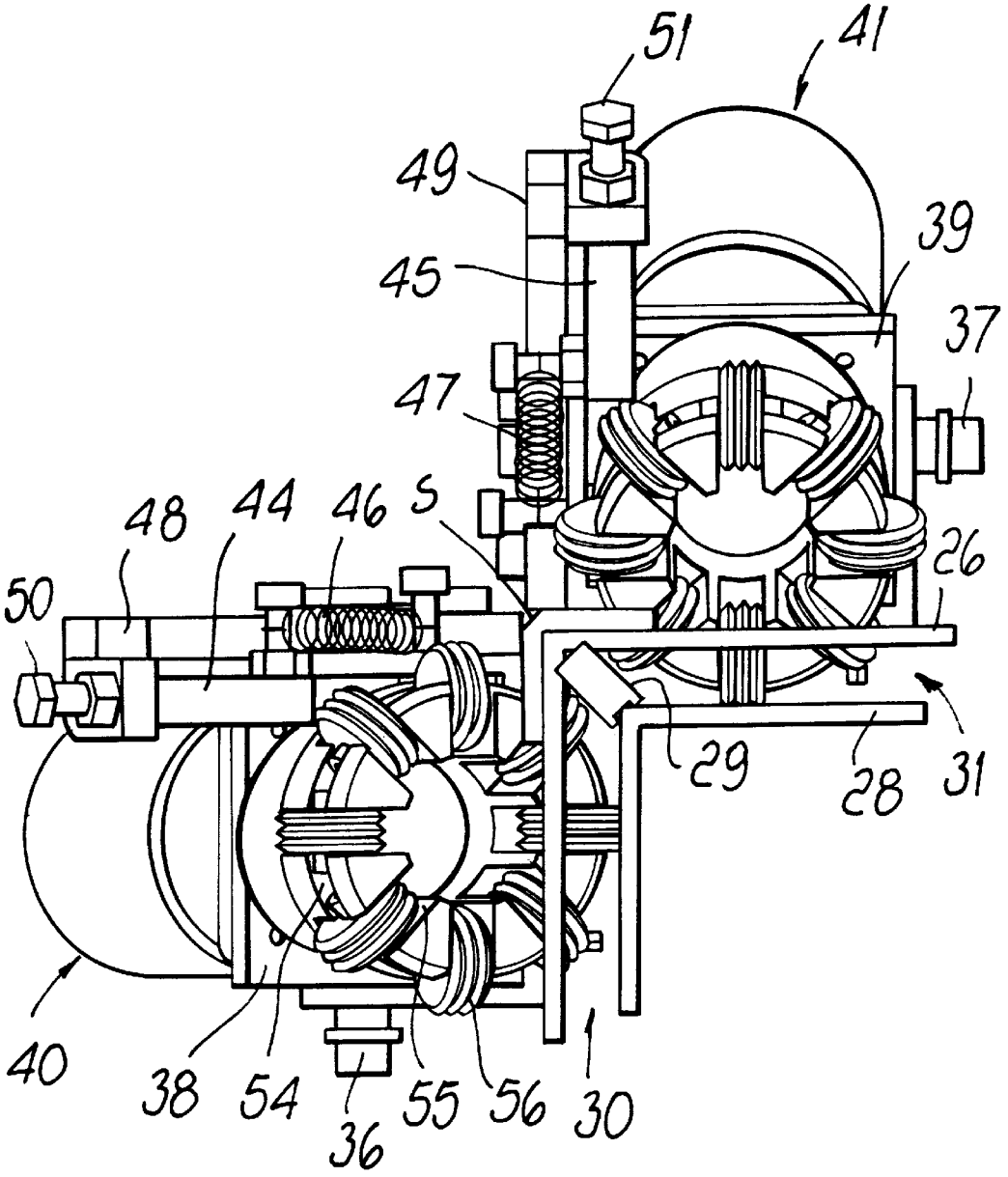
FIG. 6 is a front elevation view of the device: and finally

In the drawings, P designates a cloth and F designates the band, while $B_P$ and $B_F$ designate the borders to be joined. As shown by FIG. 1, the borders $B_P$ and $B_F$ are mutually perpendicular and the sewing machine 1 is inclined at 45° with respect to the horizontal plane, so that the sewing needle moves at right angles to the bisecting line of the angle formed by the borders $B_P$ and $B_F$.

The sewing machine 1 comprises, in a known manner, a head 2 in which the sewing needle is guided and a footing 3, in which the crochet and the fabric feeder are arranged.

The device which, according to the present invention, automatically positions the borders $B_P$ and $B_F$ mutually adjacent before they arrive at the sewing area is mounted on the head 2. Said device is generally designated by the reference numeral 4 and comprises an angular element 5, to which a block 6 is fixed which protrudes upward. The lower end of the vertical arm 7 of an L-shaped element is coupled to the block 6; the other arm 8 of said L-shaped element protrudes horizontally from the top of the arm 7. The arms 7 and 8 are vertically and horizontally adjustable by means of a kind of fixing system which comprises screws 9 and 10 which, through slots 11 and 12 of said arms, engage the block 6 and an additional block 13 which is fixed to the top of the arm 7.

A fork 14 is rigidly coupled to the end of the horizontal arm 8 which is opposite to the end fixed to the block 13 (FIG. 2); said fork has two horizontal prongs which are perpendicular to the arm 8 and are articulated, by means of a vertical pivot 15, to a body 16 which is supported by a plate 17 which is fixed by means of screws 17*a* to the side of the head 2. The body 16 has a tenon 18 which is guided in a horizontally elongated slot 19 of the plate 17 and can be locked along said slot by means of a locking screw 20. By acting on the screw 20 it is possible to adjust the position of the bracket 7, 8 and therefore of the angular element 5 upstream of the sewing needle.

A horizontal bar 21 is rigidly coupled to the body 16, passes through the C-shaped bend of the sewing machine 1 and has, at its end, a lug 22 for the articulation of the cylinder of a pneumatic jack 23, whose stem is articulated to a lug 24 which is rigidly coupled to the upper prong of the fork 14.

The angular element 5 (see FIG. 4) comprises two walls 25 and 26 which are mutually joined so as to enclose a right angle, inside which two additional shorter walls 27 and 28 are arranged which also form a right angle and are parallel to the respective walls 25 and 26. The walls 25 and 26 are hereinafter referenced as outer walls and form the corner S, while the walls 27 and 28 are referenced as inner walls, owing to the fact that they are located inside the right angle formed by the outer walls.

The numeral 29 designates a ridge which joins the outer corner S, formed by the walls 25 and 26, to the inner corner, formed by the walls 27 and 28.

The inner walls 27 and 28 form, together with the outer walls 25 and 26, two laminar channels 30 and 31 which act as guides for the borders $B_F$ and $B_P$ of the band F and of the cloth P.

Two rectangular openings 32 and 33 are formed in the outer walls 25 and 26 and lie opposite to the inner walls 27 and 28.

Two respective pairs of L-shaped elements 34, 35 (FIGS. 3–6) are fixed to the outer walls 25 and 26, upstream of the openings 32 and 33. Two respective mounting frames 38, 39 for two gearmotors 40, 41 provided with feed heads 42, 43 are supported, so that they can oscillate, between the L-shaped elements of each pair. The axes of the pivots 36, 37 are perpendicular to each other and to the corner S of the angular element 5, so that the gearmotors 40, 41 can oscillate on planes which are perpendicular to the outer walls 25, 26 and parallel to the corner S.

The frames 38, 39 have bars 44, 45 which protrude from both sides with respect to the frames. The ends of two traction springs 46, 47 are rigidly coupled to the ends of the bars 44, 45 that protrude toward the heads 42, 43; the opposite ends of said springs are rigidly coupled to pins which protrude from the L-shaped elements 34, 35. The springs 46, 47 actuate the gearmotors 40, 41 so that the heads 42, 43, through the openings 32, 33, can act on the borders $B_F$ and $B_P$ of the band F and of the cloth P guided in the channels 30 and 31.

The numerals 48 and 49 designate two posts which are fixed to the respective L-shaped elements 34, 35 and whose ends are folded so as to form lugs for the engagement of adjustment screws 50, 51 which act as abutments for the frames 38, 39. The screws 50, 51 are adjusted so that when the frames abut against them the heads 42, 43 skim the inner walls 27, 28 of the angular element S without touching them.

The feed heads 42, 43 are mutually identical and comprise a sleeve 52 (FIGS. 5 and 6) which is provided, at its end, with a collar 53 and is rotationally coupled to the output shaft of the respective gearmotor 40, 41, with the interposition of a torque limiter. An annular slot 54 is formed in the collar 53, is open outward and is intersected by a plurality of radial slots which are angularly equidistant and form seats 55.

A peripherally knurled roller 56 is arranged in each seat 55 and can rotate on a bush 57 which is accommodated in the slot 54.

A ring 58 is guided through the bushes 57 of the various rollers and retains them in their seats. The rollers 56 are advantageously curved with a curvature whose center lies on the rotation axis of the respective heads 42, 43.

The operation of the described device is as follows. The borders $B_F$ and $B_P$ of the band F and of the cloth P are inserted in the channels 30 and 31 and are inserted between the rollers 56 and the inner walls 27, 28.

The rollers 56, thanks to the slow rotation imparted to the heads 42, 43 by the gearmotors 40, 41, push the borders BP and BF towards the ridge 29, so that at the exit of the channels 30, 31 the borders $B_F$ and $B_P$ are mutually adjacent and are guided in this position below the needle of the machine 1, where they are joined by a seam. While they are pushed one against the other, the borders $B_F$ and $B_P$ slide along the channels 30, 31 and are pressed against the inner walls 27, 28 by the rollers 56, which roll thereon by friction.

It is evident that the described invention fully achieves the intended aim. In particular, the rollers 56 automatically place the borders $B_F$ and $B_P$ mutually adjacent; in conventional hemming machines, this is performed manually.

If the borders $B_P$ and $B_F$ jam in the channels 30, 31, the torque limiters provided in the gearmotors 40 and 41 stop the rotating heads 42, 43, preventing the rollers 56 from damaging the cloth P and the band F.

It should be noted that the described device does not hinder in any way the traction performed by the feeder of the sewing machine or the application of the tape N which is usually applied to cover the seam with the aid of a suitable guide 59.

Said guide 59, for example, is of the type already disclosed in EPA 95100119.7 published 0664354 by same Applicant, and is constituted by a body which is adapted to fold a tape for making it become U-shaped, so as to surround the two adjacent borders before sewing.

As shown in the figures, the device, through the ability of the gearmotors to oscillate about the axes of the pivots 36, 37, is capable of adapting to the thickness of the cloth P and of the band F.

Figure 8:
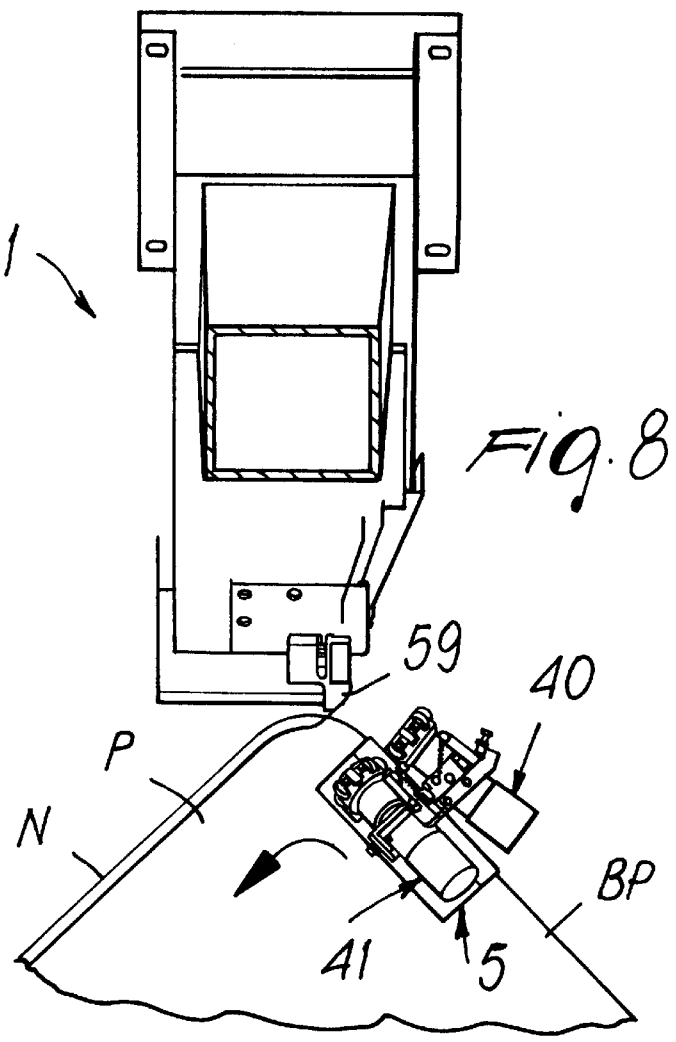
FIGS. 7 and 8 are two plan views of the sewing machine and of the device in two operating conditions.
Figure 7:
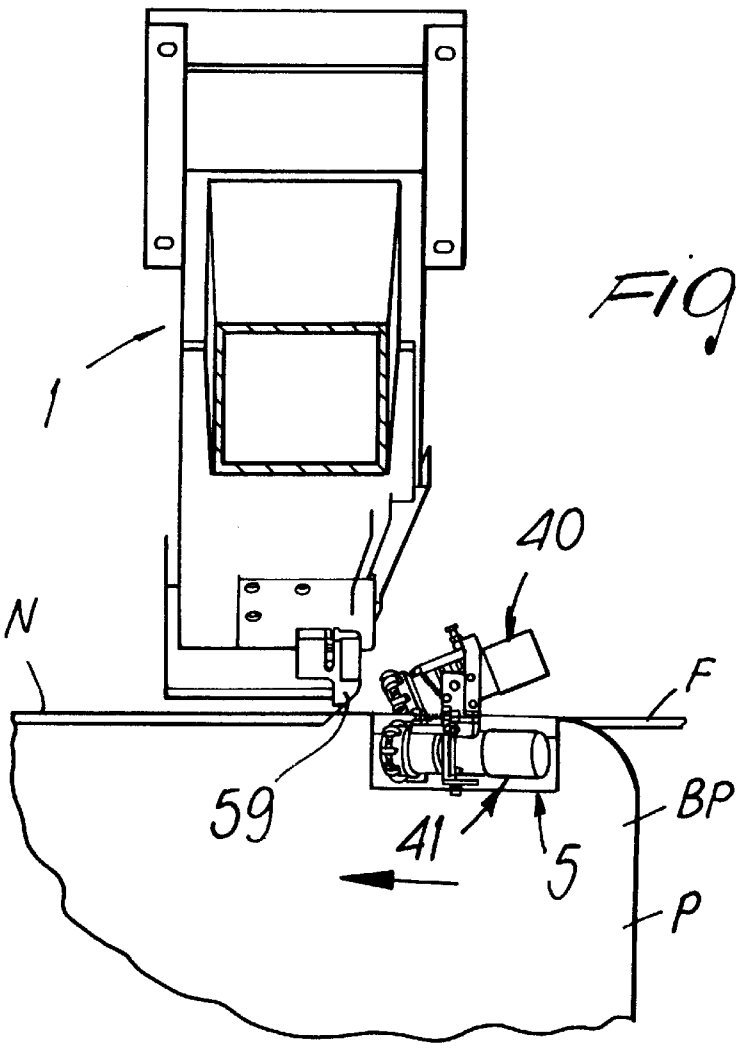

Furthermore the device is capable of following the contour of the cloth. In particular, by rotating about the pivot 15, it allows to place the borders $B_P$ and $B_F$ of the cloth P and of the band F mutually adjacent even when the sewing needle follows a curved path at the corners of the mattress, as shown in FIGS. 7 and 8. The rotation of the device at the corners of the mattress is advantageously controlled positively by the jack 23, which is controlled by a sensor which is adapted to detect the approach of the corner of the mattress, at which the cloth and the band are to be joined.

What is claimed is:

1. A device for positioning and joining at an angle, with a sewing machine, borders of two flaps of fabric, particularly of a horizontal cloth and of a vertical band for forming a case of a mattress, comprising: an angular element including two walls, a first laminar channel, said first laminar channel forming a guide for a border of the cloth, and a second laminar channel, forming a guide for a border of the band, said channels being arranged at a right angle one with respect to the other and each channel being comprised between said two walls, a first one of said two walls being external to said channels, and a second one of said two walls being internal thereto; respective through openings being formed in said first, external wall; two feeders; and rotating heads, provided at said feeders, said rotating heads being arranged so as to tangentially engage the borders of said cloth and of said band through said through openings in order to position said borders of said cloth and of said band, while said borders are being guided in said channels, adjacent to each other.

2. The device according to claim 1, further comprising: an L-shaped element which is articulated about a vertical axis to said sewing machine, said angular element being mounted on said L-shaped element; arms which allow a vertical and horizontal adjustment of said angular element with respect to the sewing needle being provided at said L-shaped element; and a pneumatic actuator for rotating said L-shaped element and said angular element.

3. The device according to claim 2, wherein said feeders comprise each a respective gearmotor, said gearmotors being supported, so as to be oscillatable, on a respective outer wall of said angular element, and said rotating heads being keyed each on an output shaft of a respective one of said gearmotors, elastic means being further provided which act on said gearmotors to keep said heads engaged on said borders through said openings.

4. The device according to claim 3, comprising: torque limiters; each said rotating head comprising a sleeve which is rotationally connected to a respective output shaft of a respective gearmotor through a respective one of said torque limiters; two annular slots being formed each on a respective one of said sleeves; a plurality of angularly equidistant seats provided at said sleeves and intersecting a respective annular slot; peripherally knurled rollers being arranged in each of said seats; a plurality of bushes which are each accommodated in a respective slot, said knurled rollers being each rotatable on a respective one of said bushes; a ring being driven through the bushes of said rollers for retaining said bushes in respective seats thereof.

5. The device according to claim 4, wherein said rollers are curved with a curvature having the center thereof located on a respective rotation axis of a respective rotating head.

* * * * *